US007063305B2

(12) United States Patent
Forestan et al.

(10) Patent No.: US 7,063,305 B2
(45) Date of Patent: Jun. 20, 2006

(54) ADJUSTMENT OF DEVICE FOR SETTING LAMINAR PLATE ELEMENTS

(75) Inventors: Egidio Forestan, Camisano Vicentino (IT); Stefano Binotto, Thiene (IT)

(73) Assignee: BIFOR S.r.l., Thiene (IT)

( * ) Notice: Subject to any disclaimer, the term of this patent is extended or adjusted under 35 U.S.C. 154(b) by 0 days.

(21) Appl. No.: 10/997,937

(22) Filed: Nov. 29, 2004

(65) Prior Publication Data

US 2005/0127340 A1 Jun. 16, 2005

(30) Foreign Application Priority Data

Dec. 10, 2003 (IT) ..... VI2003A0249

(51) Int. Cl.
*B66F 3/24* (2006.01)

(52) U.S. Cl. ..... 254/93 R

(58) Field of Classification Search ..... 254/98, 254/100, 93 R, 7 B, DIG. 1, 93 H, 2 B
See application file for complete search history.

(56) References Cited

U.S. PATENT DOCUMENTS

| | | | | | |
|---|---|---|---|---|---|
| 1,823 | A * | 10/1840 | Wolford | ..... | 401/86 |
| 829,344 | A * | 8/1906 | Larsen | ..... | 254/100 |
| 3,603,552 | A * | 9/1971 | Wheelock | ..... | 254/98 |
| 3,874,256 | A * | 4/1975 | Korb et al. | ..... | 81/484 |
| 5,379,987 | A * | 1/1995 | Cleary | ..... | 254/134 |
| 6,581,911 | B1 * | 6/2003 | Scott | ..... | 254/100 |
| 2005/0127340 | A1 * | 6/2005 | Forestan et al. | ..... | 254/98 |

* cited by examiner

*Primary Examiner*—Lee D. Wilson
(74) *Attorney, Agent, or Firm*—Dykema Gossett PLLC

(57) ABSTRACT

An adjustment device for setting laminar plate elements having a nut screw supported by a bearing structure and a threaded through hole for receiving the screw. The screw has an end protruding from the nut screw having a reference plane for supporting the lower edge of the laminar element to be set. The horizontal slide has its outer surface supported by the reference plane and its inner surface for supporting the screw. The vertical side supports the outer surface of the laminar element.

10 Claims, 3 Drawing Sheets

ADJUSTMENT OF DEVICE FOR SETTING LAMINAR PLATE ELEMENTS

BACKGROUND OF THE INVENTION

The present invention is about an adjustment device for setting laminar plate elements.

In particular, the adjustment device is usefully employed for setting glass sheets, which are aligned in a vertical position to carry out glazed frames or windows, and glass or crystal transparent surfaces in general.

It is known that the operation of alignment in a vertical position of laminar plate elements, in particular made of glass and crystal, is a laborious and delicate operation which is performed at present using wedge-shaped shims.

In particular, wedge-shaped shims made of wood or other yielding material are used, which are interposed between the lower edge of the vertically disposed sheets and the respective bearing surface.

The operator, acting with thrusting means, for instance with a hammer, horizontally moves the shims so that the inclined surfaces of said shims, on which the sheet edges are supported, cause an upwardly directed force component which vertically moves the sheets in order to mutually align them on a vertical plane.

It is known for those skilled in the art that the use of the aforementioned wedge-shaped shims has some acknowledged inconveniences.

A first inconvenience is due to the fact that the sheet alignment operation is time-consuming and laborious, since the shims have to be forced with a lot of attention and care, with repeated strokes of small intensity to avoid to damage the sheets and to obtain small vertical displacements which allow to reach in a precise manner the desired alignment condition. Therefore, it should be understood that, operating in the above described way, the alignment operation requires a particular experience and it has to be performed by properly skilled personnel.

Another inconvenience is due to the fact that the sheet, when the shims are horizontally forced between the bearing surface and the sheet edge, besides being vertically lifted up, is also inevitably horizontally moved, and this further complicates the alignment work of the operator.

A further inconvenience is due to the fact that, during the setting, the inclined surfaces of the shims scrape against the sheet edges and they could damage said sheets.

Not the least inconvenience is due to the fact that, using the shims, it is not possible to perform a micrometric adjustment and thus to obtain, at each shim, the same lifting stress value on the sheet.

The present invention intends to overcome the aforementioned inconveniences.

SUMMARY OF THE INVENTION

It is a first object of the invention to provide for an adjustment device which allows to set the sheets through a very precise adjustment of their lifting.

It is another object that the adjustment device of the invention allows to set the sheets by applying them vertical displacements only.

It is a further object that the adjustment device of the invention is easier to use with respect to the known devices.

Still another object is that, using the device of the invention, the setting of the sheets can also be executed by unskilled personnel.

Not the least object is that the adjustment device of the invention allows to perform the sheets setting operation in greater safety conditions.

Said objects are obtained by an adjustment device for setting laminar plate elements which, according to the main claim, is characterized by comprising at least a nut screw supported by a bearing surface and provided with a threaded hole in which a screw is inserted, said screw having the end protruding from said nut screw, said end being provided with a reference plane able to support the lower edge of said laminar element to be set.

Preferably, according to the executive embodiment of the hereby described invention, the angle has a cross sectional L shape, whose horizontal side is supported by the reference fixed plane, while the vertical side is used as a support for the laminar plate element.

An outer surface, supported by the reference fixed plane, and an inner surface opposed to the outer surface, on which the nut screw is supported, are obtained in the horizontal side.

The end of the screw protruding from the nut screw has a head with a hexagonal profile which can be easily operated through a fork spanner.

According to another executive embodiment, the end of the screw protruding from the nut screw has a head with a circular profile provided with radial holes able to receive a handling pin.

According to a further executive embodiment, the end of the screw protruding from the nut screw is without head and it is provided with radial holes able to receive a handling pin.

Advantageously, the adjustment device of the invention makes the laminar plate elements setting operation safer, quicker and also easy to perform by not particularly skilled personnel.

More advantageously, the adjustment device of the invention could be used to lift up and set laminar plate elements of any kind and weight.

BRIEF DESCRIPTION OF THE DRAWINGS

The aforesaid objects and advantages will be better highlighted in the description of preferred embodiments of the invention, given in an explanatory but not limiting way, with reference to the FIGS. of the annexed drawings, wherein.

DESCRIPTION OF THE INVENTION

Figure 1:
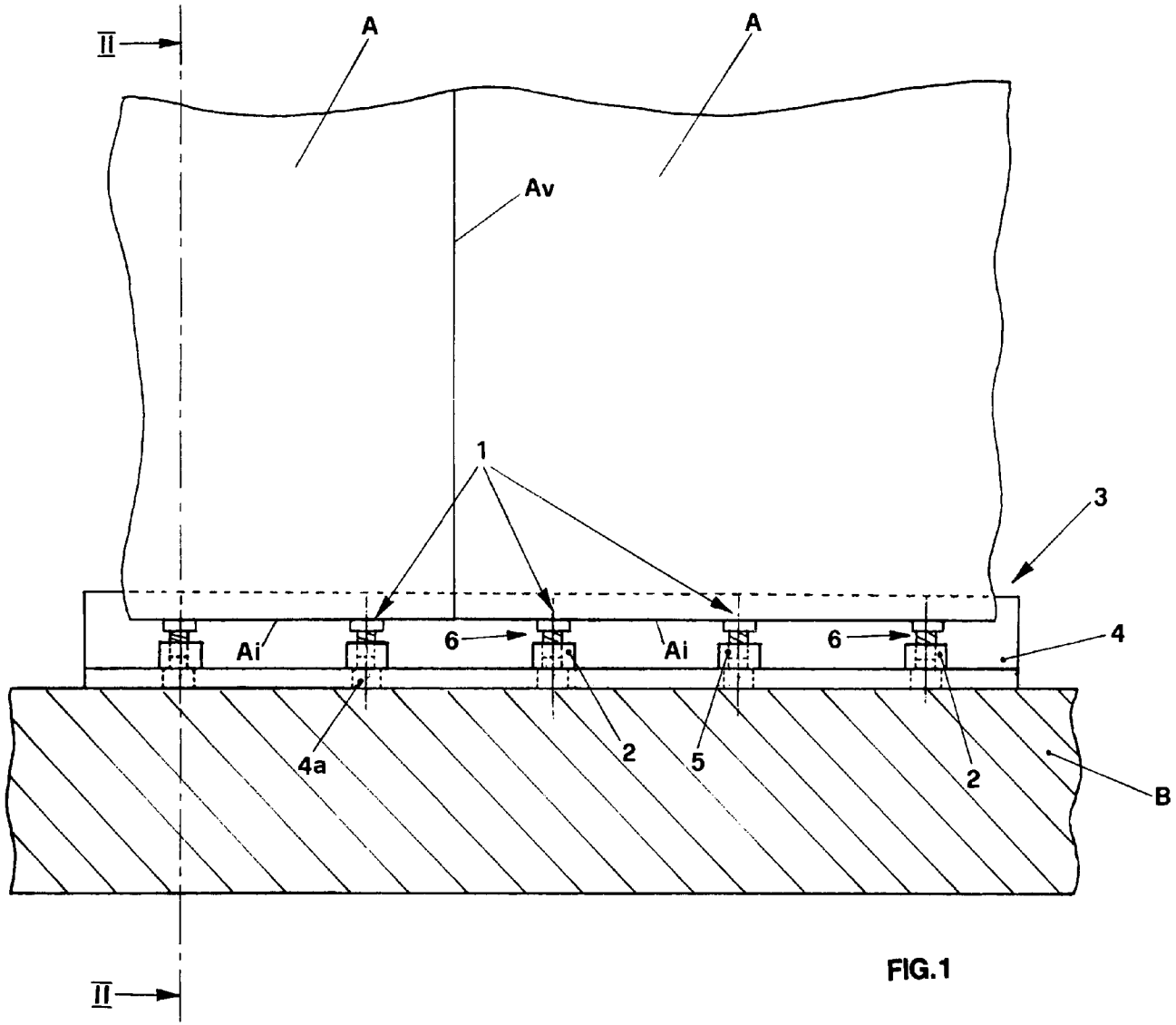
FIG. 1 is a schematic front view of several adjustment devices during the setting stage of two laminar plate elements disposed side by side.

As one can see in the figures, the adjustment device of the invention, generally indicated with numeral 1, is used to set laminar plate elements, indicated with A, which are mutually aligned and disposed side by side in a vertical position.

It should be pointed out that the laminar plate elements A could be marble plates, wooden panels or similar laminar elements, but the adjustment device of the invention will be preferably used to set laminar elements A consisting of glass or crystal sheets.

According to the invention, the adjustment element 1 comprises a nut screw 2 supported by a bearing surface 3, preferably but not necessarily consisting of an angle 4, provided with a threaded hole 5 in which a screw 6 is inserted.

Alternatively, the bearing surface 3 could also be a fixed plane B on which the nut screw 2 is directly supported.

In the specific case described hereby, the angle 4 has a cross sectional L shape in which a horizontal side 7 and a vertical side 8, substantially mutually orthogonal, are formed.

More precisely, one can see that the horizontal side 7 has its outer surface 7*a* supported by a fixed reference plane B and its inner surface 7*b* which supports the nut screw 2.

Concerning instead the vertical side 8, it has an inner surface 8*a* on which the outer surface of the plate A is supported.

Figure 3:
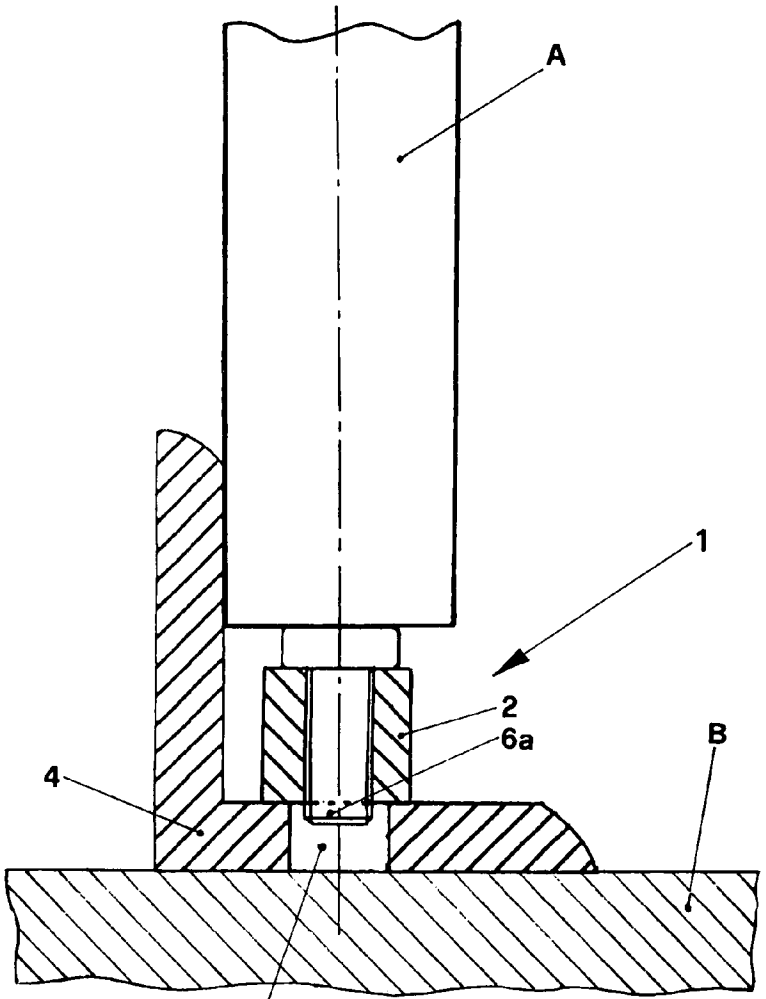
FIG. 3 shows the adjustment device of FIG. 2 in a different position.
Figure 2:
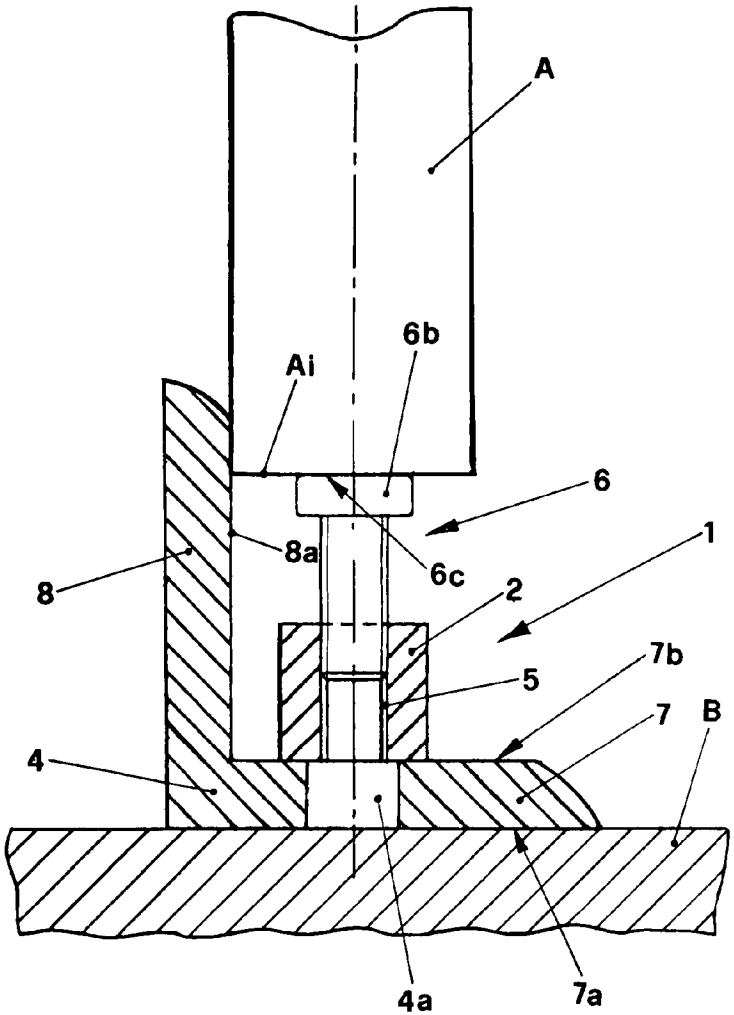
FIG. 2 is a cross sectional view of the adjustment device of the invention shown in FIG. 1 according to the sectional plane II—II.

A through hole 4*a* is obtained in the horizontal side 7 of the angle 4, said hole having a greater diameter with respect to the diameter of the threaded hole 5 of the nut screw 2, in order to house the end 6*a* of the screw 6 when it is completely screwed in the nut screw, as shown in FIG. 3.

Figure 4:
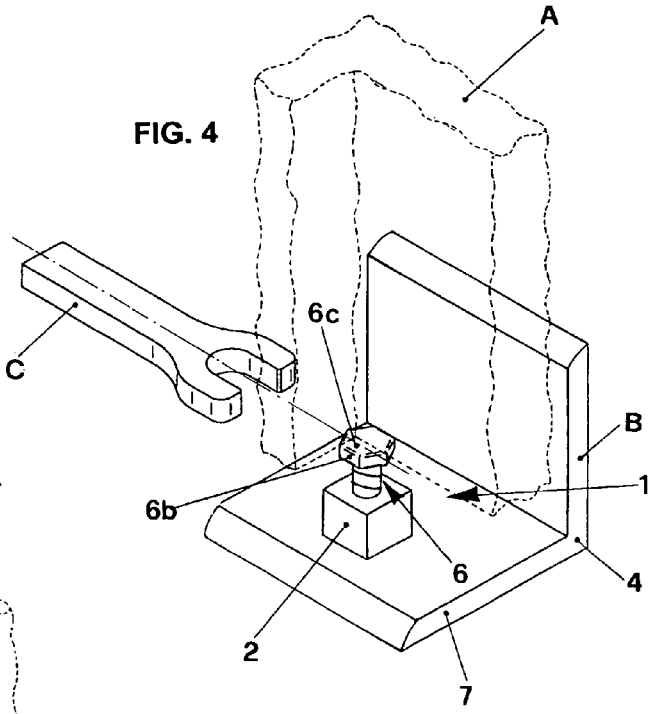
FIG. 4 is an axonometric view of an enlarged detail of the adjustment device of the invention, with a partial view of the laminar plate element to be set.
Figure 5:
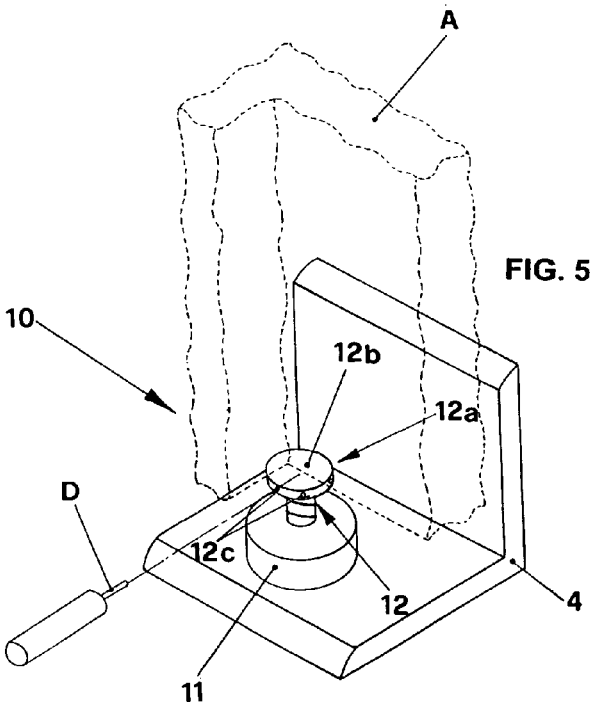
FIGS. 5 and 6 show other executive embodiments of the adjustment device of the invention.
Figure 6:
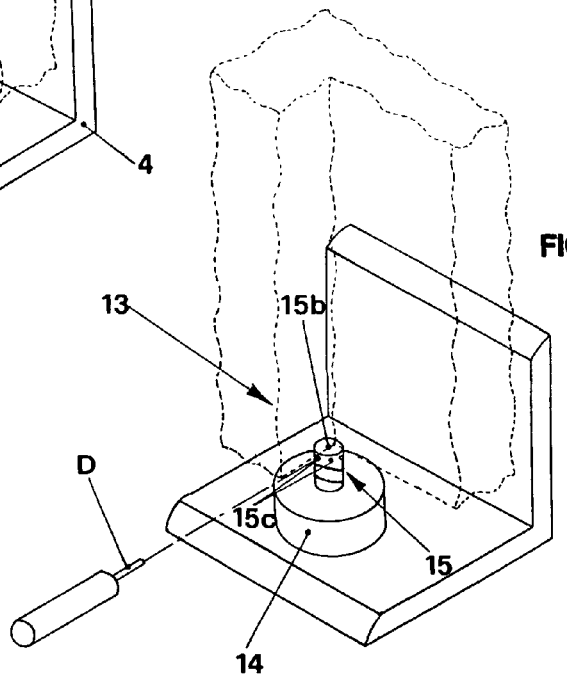

As one can see in FIG. 4, the nut screw 2 has a square shape, but it can also have any other prismatic or circular shape, as one can see in FIGS. 5 and 6.

Concerning the screw 6, it has the end protruding from the nut screw 2 provided with a hexagonal head 6*b*, in order to be operated with a fork spanner C shown in FIG. 4.

A reference plane 6*c* for supporting the lower edge Ai of the plate A is obtained in the hexagonal head 6*b*.

According to a different executive embodiment, shown in FIG. 5, the device of the invention, generally indicated with numeral 10, comprises the circular shaped nut screw 11 and the screw 12 having its circular shaped head 12*a* with a bearing surface 12*b* and radial holes 12*c* able to receive the insertion of a handling pin D for the screw rotation.

According to another executive embodiment, shown in FIG. 6, the device of the invention, generally indicated with numeral 13, comprises the circular shaped nut screw 14 and the screw 15, having no head, with a bearing surface 15*b* and radial holes 15*c* able to receive the insertion of a handling pin D for the screw rotation.

Operatively, to set the plates A, first of all the angle 4 has to be disposed on the fixed plane B, which can be indifferently a floor or any other surface, like for instance a kerbstone, a slab, the threshold of a window or a door, or another fixed surface of any kind.

Then, the nut screws of a plurality of adjustment devices 1 are put on the angle 4 and the lower edges Ai of the plates A are disposed on the screws.

The operator or the operators maintain the plates A in a vertical position and, contemporarily acting on each of the screws through the spanner C or the pin D, rotate said screws until bringing the plates to be mutually adjacent, on the same plane and with their vertical edges Av in contact one to another.

It should be understood that the adjustment element 1 of the invention develops all its effectiveness because, by rotating the screws, it is possible to apply to the lower edge Ai of each plate A a vertical lifting stress only, and thus to completely avoid the possibility that, during the adjustment, the plate is horizontally displaced too, as it happens using wedge-shaped shims of known type.

According to the plate weight and kind, several adjustment devices will be used, so that the specific load at each device is sufficiently low and unable to damage it.

Once the adjustment is obtained, the plates aligned in this way will be fixed to the structure which will support them.

At this point, the adjustment devices can be easily removed by pulling back the screws in the respective nut screws, possibly using also the return allowed by the through holes obtained in the angle.

On the basis of the aforesaid description, it should be understood that the adjustment device of the invention achieves all the intended objects and allows an operator to perform the work in greater safety conditions and in a quicker way too.

The adjustment device of the invention could be made with any shape and size, and of any kind of material, in the executive stage.

It is intended that all the constructive embodiments of the adjustment device of the invention, not described and not shown in the drawings, if they fall within the scope of protection of the following claims, should be intended as protected by the present patent.

The invention claimed is:

1. An adjustment device for setting laminar plate elements, comprising:

at least a nut screw supported by a bearing structure and provided with a threaded through hole in which a screw is inserted, said screw having the end protruding from said nut screw, said end being provided with a reference plane able to support the lower edge of said laminar element to be set; and wherein said bearing structure comprises of an angle in which are obtained:

a horizontal side having its outer surface supported by said fixed reference plane and its inner surface, opposed to said outer surface, on which said nut screw is supported; and a vertical side, whose inner surface supports the outer surface of said laminar element.

2. The adjustment device is a through hole.

3. The adjustment device according to claim 1, wherein said bearing structure consists of a fixed reference plane.

4. The adjustment device according to claim 1, wherein said horizontal side has one or more through holes with greater diameter with respect to the diameter of said threaded hole of said nut screw.

5. The adjustment device according to claim 1, wherein said screw is provided with a hexagonal head.

6. The adjustment device according to claim 1, wherein said screw is provided with a circular shaped head.

7. The adjustment device according to claim 6, wherein said screw has radial holes.

8. The adjustment device according to claim 1, wherein said screw is without head.

9. The adjustment device according to claim 1, wherein said nut screw has square shape.

10. The adjustment device according to claim 1, wherein said nut screw has circular shape.

* * * * *